US008693935B2

(12) United States Patent
Eiki

(10) Patent No.: US 8,693,935 B2
(45) Date of Patent: Apr. 8, 2014

(54) FIXING UNIT AND IMAGE FORMING APPARATUS

(75) Inventor: Takashi Eiki, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 105 days.

(21) Appl. No.: 13/344,463

(22) Filed: Jan. 5, 2012

(65) Prior Publication Data

US 2012/0177421 A1 Jul. 12, 2012

(30) Foreign Application Priority Data

Jan. 7, 2011 (JP) ..... 2011-002266

(51) Int. Cl.
*G03G 15/00* (2006.01)
*G03G 15/20* (2006.01)

(52) U.S. Cl.
CPC ..... *G03G 15/2064* (2013.01)
USPC ..... 399/329; 399/328; 399/330; 399/331

(58) Field of Classification Search
CPC ..... G03G 15/20; G03G 15/2064
USPC ..... 399/130–342
See application file for complete search history.

(56) References Cited

U.S. PATENT DOCUMENTS 6,725,009 B1 * 4/2004 Tatematsu et al. ..... 399/329
6,757,513 B2 * 6/2004 Terada et al. ..... 399/328
6,795,679 B2 * 9/2004 Shimizu et al. ..... 399/333
6,810,230 B2 * 10/2004 Imai et al. ..... 399/328
6,845,226 B2 * 1/2005 Tatematsu et al. ..... 399/329
6,872,925 B2 * 3/2005 Asakura et al. ..... 219/619
6,968,137 B2 * 11/2005 Tatematsu et al. ..... 399/69
7,006,781 B2 * 2/2006 Imai et al. ..... 399/333
7,043,184 B2 * 5/2006 Kagawa et al. ..... 399/328
7,079,800 B2 * 7/2006 Asakura et al. ..... 399/328
7,194,234 B2 * 3/2007 Katakabe et al. ..... 399/330
7,383,010 B2 * 6/2008 Isayama et al. ..... 399/329
7,424,259 B2 * 9/2008 Samei et al. ..... 399/329
7,427,729 B2 * 9/2008 Asakura et al. ..... 219/619
7,437,112 B2 * 10/2008 Yamaji ..... 399/328
7,486,923 B2 * 2/2009 Imai et al. ..... 399/333
7,486,924 B2 * 2/2009 Ito ..... 399/333
7,620,336 B2 * 11/2009 Yura et al. ..... 399/67

(Continued)

FOREIGN PATENT DOCUMENTS

JP 2006-10729 A 1/2006

OTHER PUBLICATIONS

Extended European Search Report issued to European Patent Application No. 12150179, dated May 3, 2012.

*Primary Examiner* — Clayton E Laballe
*Assistant Examiner* — Kevin Butler
(74) *Attorney, Agent, or Firm* — Knobbe Martens Olson & Bear LLP

(57) ABSTRACT

A fixing unit includes a heating rotary belt, a pressing member that abuts with an inner surface of the heating rotary belt, a pressing rotor that forms a fixing nip with the heating rotary belt, a induction coil separated by a predetermined distance from the external surface of the heating rotary belt and generating a magnetic flux to generate heat in the heating rotary belt, a magnetic core portion that forms a magnetic path for the magnetic flux generated by the induction coil, and a regulating portion that regulates the deformation of the heating rotary belt by abutment with the external surface of the heating rotary belt.

7 Claims, 7 Drawing Sheets

(56) References Cited

U.S. PATENT DOCUMENTS

| | | | | |
|---|---|---|---|---|
| 7,796,933 | B2 * | 9/2010 | Ueno et al. | 399/333 |
| 7,801,457 | B2 * | 9/2010 | Seo et al. | 399/69 |
| 7,835,679 | B2 * | 11/2010 | Baba et al. | 399/329 |
| 7,907,882 | B2 * | 3/2011 | Hara | 399/329 |
| 7,925,197 | B2 * | 4/2011 | Takagi et al. | 399/329 |
| 8,055,174 | B2 * | 11/2011 | Yoshikawa | 399/329 |
| 8,112,023 | B2 * | 2/2012 | Seo et al. | 399/328 |
| 8,126,346 | B2 * | 2/2012 | Yura et al. | 399/67 |
| 8,145,112 | B2 * | 3/2012 | Baba | 399/329 |
| 2002/0190060 | A1 * | 12/2002 | Imai et al. | 219/619 |
| 2004/0101334 | A1 * | 5/2004 | Tatematsu et al. | 399/329 |
| 2004/0105708 | A1 * | 6/2004 | Imai et al. | 399/330 |
| 2004/0156661 | A1 * | 8/2004 | Kagawa et al. | 399/328 |
| 2004/0161270 | A1 * | 8/2004 | Asakura et al. | 399/328 |
| 2005/0152720 | A1 * | 7/2005 | Katakabe et al. | 399/330 |
| 2005/0201783 | A1 * | 9/2005 | Kurotaka et al. | 399/329 |
| 2005/0260017 | A1 * | 11/2005 | Isayama et al. | 399/329 |
| 2006/0147221 | A1 * | 7/2006 | Asakura et al. | 399/69 |
| 2006/0210330 | A1 * | 9/2006 | Sone et al. | 399/328 |
| 2007/0110466 | A1 * | 5/2007 | Yamaji | 399/69 |
| 2007/0122214 | A1 * | 5/2007 | Samei et al. | 399/329 |
| 2007/0242988 | A1 * | 10/2007 | Seo et al. | 399/328 |
| 2007/0242990 | A1 * | 10/2007 | Ohhara et al. | 399/329 |
| 2008/0063445 | A1 * | 3/2008 | Imai et al. | 399/333 |
| 2008/0118282 | A1 * | 5/2008 | Takagi et al. | 399/329 |
| 2008/0124109 | A1 * | 5/2008 | Sone et al. | 399/67 |
| 2008/0205948 | A1 * | 8/2008 | Baba et al. | 399/329 |
| 2008/0232873 | A1 * | 9/2008 | Ueno et al. | 399/333 |
| 2009/0067903 | A1 * | 3/2009 | Yokoyama et al. | 399/330 |
| 2009/0142114 | A1 * | 6/2009 | Yasuda et al. | 399/333 |
| 2009/0148206 | A1 * | 6/2009 | Yoshikawa | 399/331 |
| 2009/0232567 | A1 * | 9/2009 | Baba | 399/329 |
| 2009/0245897 | A1 * | 10/2009 | Seo et al. | 399/328 |
| 2009/0290915 | A1 * | 11/2009 | Baba | 399/329 |
| 2009/0290917 | A1 * | 11/2009 | Baba et al. | 399/329 |
| 2010/0021195 | A1 * | 1/2010 | Yura et al. | 399/70 |
| 2010/0129124 | A1 * | 5/2010 | Hara | 399/333 |
| 2010/0178088 | A1 * | 7/2010 | Koshida et al. | 399/328 |
| 2010/0303521 | A1 * | 12/2010 | Ogawa et al. | 399/323 |
| 2010/0322681 | A1 * | 12/2010 | Kikuchi et al. | 399/323 |
| 2011/0091253 | A1 * | 4/2011 | Seo et al. | 399/333 |
| 2011/0150546 | A1 * | 6/2011 | Koshida | 399/329 |
| 2011/0170918 | A1 * | 7/2011 | Takagi et al. | 399/329 |
| 2011/0229170 | A1 * | 9/2011 | Shimizu | 399/45 |
| 2011/0236091 | A1 * | 9/2011 | Tanda | 399/330 |
| 2012/0057909 | A1 * | 3/2012 | Gon | 399/329 |
| 2012/0099909 | A1 * | 4/2012 | Nanjo | 399/329 |
| 2012/0155918 | A1 * | 6/2012 | Egi | 399/122 |
| 2012/0177421 | A1 * | 7/2012 | Eiki | 399/329 |
| 2012/0207502 | A1 * | 8/2012 | Seo | 399/69 |
| 2012/0243922 | A1 * | 9/2012 | Uehara et al. | 399/329 |
| 2012/0321333 | A1 * | 12/2012 | Baba | 399/69 |
| 2012/0328340 | A1 * | 12/2012 | Iwai | 399/329 |
| 2013/0071154 | A1 * | 3/2013 | Egi | 399/329 |

* cited by examiner

FIXING UNIT AND IMAGE FORMING APPARATUS

This application is based on and claims the benefit of priority from Japanese Patent Application No. 2011-002266, filed on 7 Jan. 2011, the content of which is incorporated herein by reference.

FIELD

The present disclosure relates to a fixing unit and an image forming apparatus provided with same.

BACKGROUND

Conventionally, reduction in startup time and energy efficiency are desirable features for an image forming apparatus such as a printer, a copier, or the like. Therefore considerable attention has been attracted by a fixing unit that uses a heating rotary belt enabling a reduction in the heat capacity.

Furthermore, considerable attention has been directed to a fixing unit that uses an induction heating method (IH) for generating heat in a heat generating layer of the heating rotary belt by an electromagnetic induction action due to magnetic flux generated by an induction coil.

A fixing unit using a heating rotary belt includes a heating rotary belt, a pressing member, and a pressure rotor. The pressing member is disposed in an inner portion of the heating rotary belt, and abuts with an inner surface of the heating rotary belt. The pressure rotor sandwiches the heating rotary belt with the pressing member and is opposed to the heating rotary belt. The heating rotary belt may deform into an ellipse shape upon application of a pressing force from the pressure rotor to thereby expand in a direction orthogonal to the direction of pressure from the pressure rotor. The heating rotary belt may deform by a deformation amount as a result of the fluctuation in the intensity of the pressing force from the pressure rotor.

As described above, deformation of the heating rotary belt may be caused in a fixing unit that includes a combination of an induction heating method (IH) and a heating rotary belt. Consequently, heating efficiency in the fixing unit may vary in response to a fluctuation in the distance between the induction coil and the outer peripheral surface of the heating rotary belt. As a result, it has sometimes not been possible to stabilize the temperature increase time when starting up the fixing unit.

However, there is a fixing unit that stabilizes a heating efficiency by enabling an adjustment of the distance between the induction coil and the outer peripheral surface of the heating rotary belt by displacement of a support member that supports the induction coil.

A configuration to enable displacement of the supporting member in a fixing unit as described above is complicated. Furthermore, this type of fixing unit does not enable a reduction in the deformation of the heating rotary belt.

SUMMARY

The present disclosure has the object of providing a fixing unit that enables stabilization of the heating efficiency in the fixing unit by regulating the deformation of the heating rotary belt with a simple configuration.

It is a further object of the present disclosure to provide an image forming apparatus that includes the fixing unit.

A fixing unit according to the present disclosure includes a heating rotary belt, a pressing member, a pressing rotor, a induction coil, a magnetic core portion and a regulating portion. The pressing member is disposed in an inner portion of the heating rotary belt and abuts with an inner surface of the heating rotary belt. The pressing rotor is disposed facing the heating rotary belt and is configured to form a fixing nip with the heating rotary belt by sandwiching the heating rotary belt with the pressing member. The induction coil is separated from an external surface of the heating rotary belt and disposed along the external surface and is configured to generate a magnetic flux to generate heat in the heating rotary belt. The magnetic core portion is configured to form a magnetic path for the magnetic flux generated by the induction coil. The regulating portion is configured to regulate the deformation of the heating rotary belt by abutment with the external surface of the heating rotary belt.

An image forming apparatus according to the present disclosure includes an image carriers forming an electrostatic latent image on a surface thereof, a development unit that develops the electrostatic image formed on the image carrier as a toner image, a transfer unit that transfers the toner image formed on the image carrier directly or indirectly to the sheet-shaped transfer material, and a fixing unit. The fixing unit is characterized by a heating rotary belt, a pressing member, a pressing rotor, a induction coil, a magnetic core portion and a regulating portion. The pressing member is disposed in an inner portion of the heating rotary belt and abuts with an inner surface of the heating rotary belt.

The pressing rotor is disposed facing the heating rotary belt and forms a fixing nip with the heating rotary belt by sandwiching the heating rotary belt with the pressing member. The induction coil is separated from an external surface of the heating rotary belt, disposed along the external surface, and are configured to generate a magnetic flux to generate heat in the heating rotary belt.

The magnetic core portion is configured to form a magnetic path for the magnetic flux generated by the induction coil. The regulating portion is configured to regulate the deformation of the heating rotary belt by abutment with the external surface of the heating rotary belt.

DETAILED DESCRIPTION OF EMBODIMENTS

A first embodiment of an image forming apparatus according to the present disclosure will be described below with reference to the figures.

Figure 1:
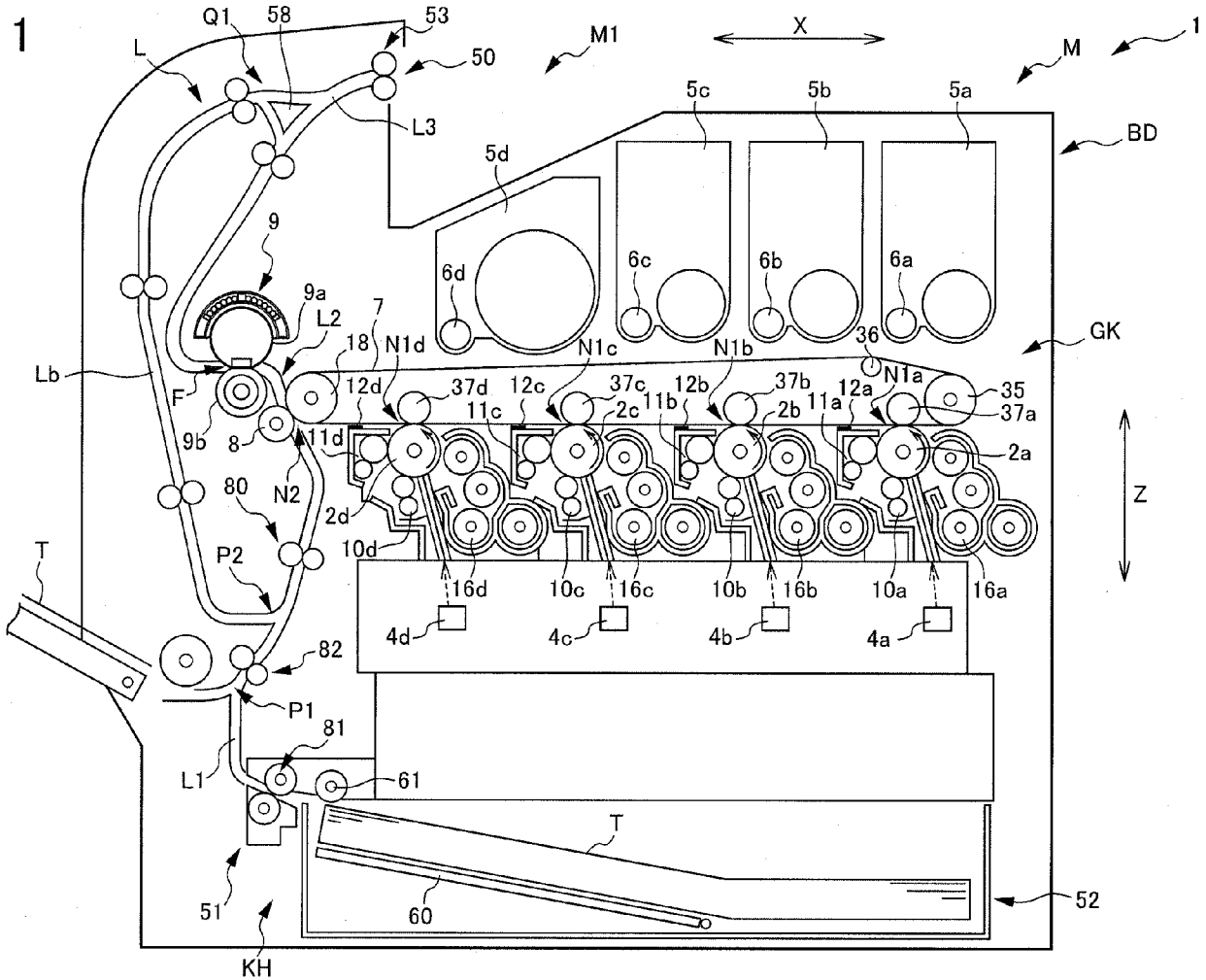
FIG. 1 illustrates the disposition of respective constituent elements in a printer according to a first embodiment of the present disclosure.

The overall structure of the printer 1 will be described with reference to FIG. 1 as an example of the image forming apparatus according to the first embodiment. FIG. 1 illustrates the disposition of respective constituent elements in the printer 1 according to the first embodiment of the present disclosure. In the following description, the perpendicular direction in FIG. 1 may simply be expressed as a "vertical direction".

As illustrated in FIG. 1, the printer 1 according to the first embodiment includes a main body M. The main body M includes an image forming unit GK and a paper feeding/discharging portion KH. The image forming unit GK forms a toner image on a sheet of paper T as a sheet-shaped transfer material on the base of image information. The paper feeding/discharging portion KH feeds the paper sheet T to the image forming unit GK and discharges the paper sheet T with the toner image formed thereon.

The outer shape of the main body M is configured by the case BD as a housing.

As illustrated in FIG. 1, the image forming unit GK includes photoreceptor drums 2*a*, 2*b*, 2*c*, and 2*d* as image carriers (photoreceptor bodies), charging units 10*a*, 10*b*, 10*c* and 10*d*, laser scanner units 4*a*, 4*b*, 4*c* and 4*d* as exposure units, developing units 16*a*, 16*b*, 16*c* and 16*d*, toner cartridges 5*a*, 5*b*, 5*c* and 5*d*, toner supply units 6*a*, 6*b*, 6*c* and 6*d*, drum cleaning units 11*a*, 11*b*, 11*c* and 11*d*, neutralization units 12*a*, 12*b*, 12*c* and 12*d*, an intermediate transfer belt 7, primary transfer rollers 37*a*, 37*b*, 37*c* and 37*d*, a secondary transfer roller 8, an opposing roller 18, and the fixing unit 9.

As illustrated in FIG. 1, the paper feeding/discharging portion KH includes a paper feed cassette 52, a conveyance path L of the sheet of paper T, a pair of registration rollers 80, a plurality of rollers or pair of rollers, and a paper discharging unit 50.

Hereafter, the configuration of the image forming unit GK and the paper feeding/discharging portion KH will be described in detail.

First, the image forming unit GK will be described.

In the image forming unit GK, in the following order on the surface of the photoreceptor drums 2*a*, 2*b*, 2*c* and 2*d*, charging is performed by the charging units 10*a*, 10*b*, 10*c* and 10*d*, exposure is performed by the laser scanner unit 4*a*, 4*b*, 4*c* and 4*d*, development is performed by the developing units 16*a*, 16*b*, 16*c* and 16*d*, primary transfer is performed by the intermediate transfer belt 7 and the primary transfer rollers 37*a*, 37*b*, 37*c* and 37*d*, neutralization is performed by the neutralization units 12*a*, 12*b*, 12*c* and 12*d*, and cleaning is performed by the drum cleaning units 11*a*, 11*b*, 11*c* and 11*d*. These operations are performed in order from the upstream to the downstream direction of rotation of the photoreceptor drums 2*a*, 2*b*, 2*c* and 2*d*.

In addition, in the image forming unit GK, secondary transfer is performed by the intermediate transfer belt 7, the secondary transfer roller 8 and the opposing roller 18, and fixing is performed by the fixing unit 9.

Each of the photoreceptor drums 2*a*, 2*b*, 2*c* and 2*d* has a cylindrical shape and functions as a photoreceptor or an image carrier. Each of the photoreceptor drums 2*a*, 2*b*, 2*c* and 2*d* is rotatably configured in the direction of the arrow illustrated in FIG. 1, about a rotational axis extending in a direction that is orthogonal to the direction of the movement of the intermediate transfer belt 7. An electrostatic latent image is formed on a surface of each of the photoreceptor drums 2*a*, 2*b*, 2*c* and 2*d*.

Each of the charging units 10*a*, 10*b*, 10*c* and 10*d* is arranged opposite to the surface of each of the photoreceptor drums 2*a*, 2*b*, 2*c* and 2*d*. Each of the charging units 10*a*, 10*b*, 10*c* and 10*d* negatively charges (negative polarity) or positively charges (positive polarity) the surface of each of the photoreceptor drums 2*a*, 2*b*, 2*c* and 2*d* in a uniform manner.

The laser scanner units 4*a*, 4*b*, 4*c* and 4*d* function as exposure units, and are respectively separated from the surface of each of the photoreceptor drums 2*a*, 2*b*, 2*c* and 2*d*.

Each of the laser scanner units 4*a*, 4*b*, 4*c* and 4*d* performs scanning exposure of the surface of each of the photoreceptor drums 2*a*, 2*b*, 2*c* and 2*d*, based on image information supplied from an external device such as a personal computer (PC), or the like. An electric charge at an exposed part of the surface of each of the photoreceptor drums 2*a*, 2*b*, 2*c* and 2*d* is removed by the scanning exposure performed by each of the laser scanner units 4*a*, 4*b*, 4*c* and 4*d*. In this manner, an electrostatic latent image is formed on the surface of each of the photoreceptor drums 2*a*, 2*b*, 2*c* and 2*d*.

The developing units 16*a*, 16*b*, 16*c* and 16*d* are respectively provided corresponding to the respective surfaces of the photoreceptor drums 2*a*, 2*b*, 2*c* and 2*d*. Each of the developing units 16*a*, 16*b*, 16*c* and 16*d* causes a toner of each color to adhere to the electrostatic latent image formed on the surface of each of the photoreceptor drums 2*a*, 2*b*, 2*c* and 2*d*, thereby forming a color toner image on the surface of each of the photoreceptor drums 2*a*, 2*b*, 2*c* and 2*d*. The developing units 16*a*, 16*b*, 16*c* and 16*d* correspond to four colors, yellow, cyan, magenta, and black, respectively. Each of the developing units 16*a*, 16*b*, 16*c* and 16*d* includes a developing roller arranged opposite to the surface of each of the photoreceptor drums 2*a*, 2*b*, 2*c* and 2*d*, and an agitation roller for agitating the toner.

The toner cartridges 5*a*, 5*b*, 5*c* and 5*d* are provided corresponding to the developing units 16*a*, 16*b*, 16*c* and 16*d*, respectively, and store the toner of each color to be supplied to each of the developing units 16*a*, 16*b*, 16*c* and 16*d*. The toner cartridges 5*a*, 5*b*, 5*c* and 5*d* store yellow toner, cyan toner, magenta toner, and black toner, respectively.

The toner supply units 6*a*, 6*b*, 6*c* and 6*d* are provided corresponding to the toner cartridges 5*a*, 5*b*, 5*c* and 5*d* and the developing units 16*a*, 16*b*, 16*c* and 16*d*, respectively. Each of the toner supply units 6*a*, 6*b*, 6*c* and 6*d* supplies the toner of each color stored in each of the toner cartridges 5*a*, 5*b*, 5*c* and 5*d* to each of the developing units 16*a*, 16*b*, 16*c* and 16*d*.

A toner image of each color, which is formed on the surface of each of the photoreceptor drums 2*a*, 2*b*, 2*c* and 2*d*, is sequentially subjected to the primary transfer to the intermediate transfer belt 7. The intermediate transfer belt 7 is suspended on a driven roller 35, the opposing roller 18 that functions as a driving roller, a tension roller 36, and the like. The tension roller 36 applies a force from an inner side to an outer side of the intermediate transfer belt 7. As a result, a predetermined tension is imparted to the intermediate transfer belt 7.

Each of the primary transfer rollers 37*a*, 37*b*, 37*c* and 37*d*, is arranged opposite to each of the photoreceptor drums 2*a*, 2*b*, 2*c* and 2*d* with the intermediate transfer belt 7 sandwiched therebetween.

The intermediate transfer belt 7 is sandwiched between each of the primary transfer rollers 37*a*, 37*b*, 37*c* and 37*d* and each of the photoreceptor drums 2*a*, 2*b*, 2*c* and 2*d*. A sandwiched part of the intermediate transfer belt 7 is pressed against the respective surfaces of each of the photoreceptor drums 2*a*, 2*b*, 2*c* and 2*d*. Primary transfer nips N1*a*, N1*b*, N1*c* and N1*d* are formed between the photoreceptor drums 2*a*, 2*b*, 2*c* and 2*d* and the primary transfer rollers 37*a*, 37*b*, 37*c* and 37*d*, respectively. At the primary transfer nips N1*a*, N1*b*, N1*c* and N1*d*, toner images of respective colors formed on the photoreceptor drums 2*a*, 2*b*, 2*c* and 2*d* are sequentially primarily transferred to the intermediate transfer belt 7. In this manner, a full color toner image is formed on the intermediate transfer belt 7.

Each of the neutralization units 12*a*, 12*b*, 12*c* and 12*d* is arranged opposite to the surface of each of the photoreceptor drums 2*a*, 2*b*, 2*c* and 2*d*.

Each of the drum cleaning units 11*a*, 11*b*, 11*c* and 11*d* is arranged opposite to the surface of each of the photoreceptor drums 2*a*, 2*b*, 2*c* and 2*d*.

The secondary transfer roller 8 causes the full color toner image primarily transferred to the intermediate transfer belt 7 to be secondarily transferred to a sheet of paper T. A secondary transfer bias for causing the full color toner image formed on the intermediate transfer belt 7 to be transferred to the sheet of paper T is applied to the secondary transfer roller 8 by a secondary transfer bias application unit (not illustrated).

The secondary transfer roller 8 is configured to come in contact with or be separated from the intermediate transfer belt 7. More specifically, the secondary transfer roller 8 is configured to be movable between a contact position in abutment with the intermediate transfer belt 7 and a separate position separated from the intermediate transfer belt 7.

The opposing roller 18 is arranged opposite the secondary transfer roller 8 relative to the intermediate transfer belt 7. The intermediate transfer belt 7 is sandwiched by the secondary transfer roller 8 and the opposing roller 18. The sheet of paper T is pressed against the outside surface (the surface where the toner image is primarily transferred) of the intermediate transfer belt 7. A secondary transfer nip N2 is formed between the intermediate transfer belt 7 and the secondary transfer roller 8. At the secondary transfer nip N2, the full color toner image primarily transferred to the intermediate transfer belt 7 is secondarily transferred to the sheet of paper T.

The fixing unit 9 melts and pressurizes the toners of respective colors forming the toner image that has been secondarily transferred to the sheet of paper T, and fixes the toner image on the sheet of paper T.

The fixing unit 9 will be described in detail below.

Next, the paper feeding/discharging portion KH will be described.

As illustrated in FIG. 1, the paper feed cassette 52 that stores sheets of paper T is arranged in a lower part of the main body M. A mounting plate 60 for placing sheets of paper T is arranged in the paper feed cassette 52. A sheet of paper T stacked on the mounting plate 60 is fed to the conveyance path L by the cassette feeder 51. The cassette feeder 51 includes a double-feed prevention mechanism that is composed of a forward feed roller 61, and a pair of feed rollers 81. The forward feed roller 61 picks up a sheet of paper T from the mounting plate 60. The pair of feed rollers 81 feed the sheet of paper T to the conveyance path L on a sheet by sheet basis.

The conveyance path L for conveying the sheet of paper T includes the first conveyance path L1, the second conveyance path L2, the third conveyance path L3 and the return conveyance path Lb. The first conveyance path L1 is a conveyance path from the cassette feeder 51 to the secondary transfer nip N2. The second conveyance path L2 is a conveyance path from the secondary transfer nip N2 to the fixing unit 9. The third conveyance path L3 is a conveyance path from the fixing unit 9 to the paper discharging unit 50. The return conveyance path Lb is a conveyance path that causes a sheet of paper, which is conveyed on the third conveyance path L3 from downstream to upstream, to be turned upside down and conveyed back to the first conveyance path L1.

In addition, a first joint portion P1 and a second joint portion P2 are formed midway on the first conveyance path L1. A first branch portion Q1 is formed midway on the third conveyance path L3.

A paper detection sensor (not illustrated) and the pair of registration rollers 80 are disposed midway on the first conveyance path L1 (more specifically between the second joint portion P2 and the secondary transfer nips N2). The paper detection sensor is a sensor for detecting the sheet of paper T. The pair of registration rollers 80 is configured to correct skew (diagonal paper feed) of the sheet of paper T and to adjust the timing of feeding the sheet of paper and the formation of a toner image at the image forming unit GK.

A pair of intermediate rollers 82 is arranged between the first joint portion P1 and the second joint portion P2 in the first conveyance path L1. The pair of intermediate rollers 82 is arranged downstream of the pair of paper feed rollers 81. The pair of intermediate rollers 82 sandwiches the sheet of paper T that is conveyed by the pair of paper feed rollers 81, and conveys the sheet of paper T to the pair of registration rollers 80.

A branch member 58 is provided at the first branch portion Q1. The branch member 58 causes the conveyance direction of a sheet of paper T conveyed from the fixing unit 9 through the third conveyance path L3 from upstream to downstream to branch off towards the paper discharging unit 50. The branch member 58 causes the conveyance direction of a sheet of paper T conveyed from the paper discharging unit 50 through the third conveyance path L3 from downstream to upstream to branch off towards the return conveyance path Lb.

The paper discharging unit 50 is formed at an end with reference to the paper conveyance direction of the third conveyance path L3. The paper discharging unit 50 is arranged at an upper part of the main body M. The paper discharging unit 50 discharges the sheet of paper T outside the main body M.

A discharged paper accumulating portion M1 is formed at an opening side of the paper discharging unit 50. The discharged paper accumulating portion M1 is formed on a top surface (external surface) of the main body M. Sensors for paper detection are arranged at predetermined locations in the respective conveyance paths.

Figure 2:
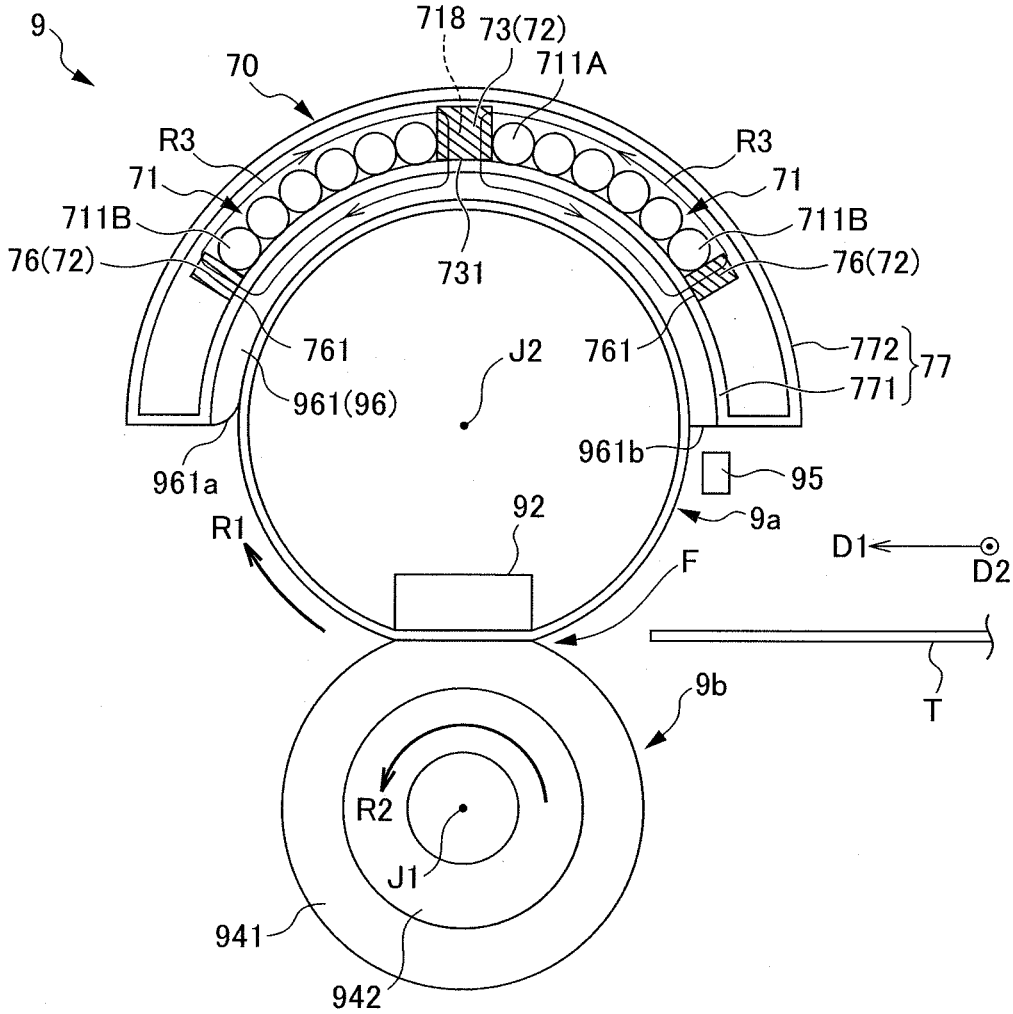
FIG. 2 is a sectional view illustrating the respective constituent elements in a fixing unit in the printer according to the first embodiment.
Figure 3:
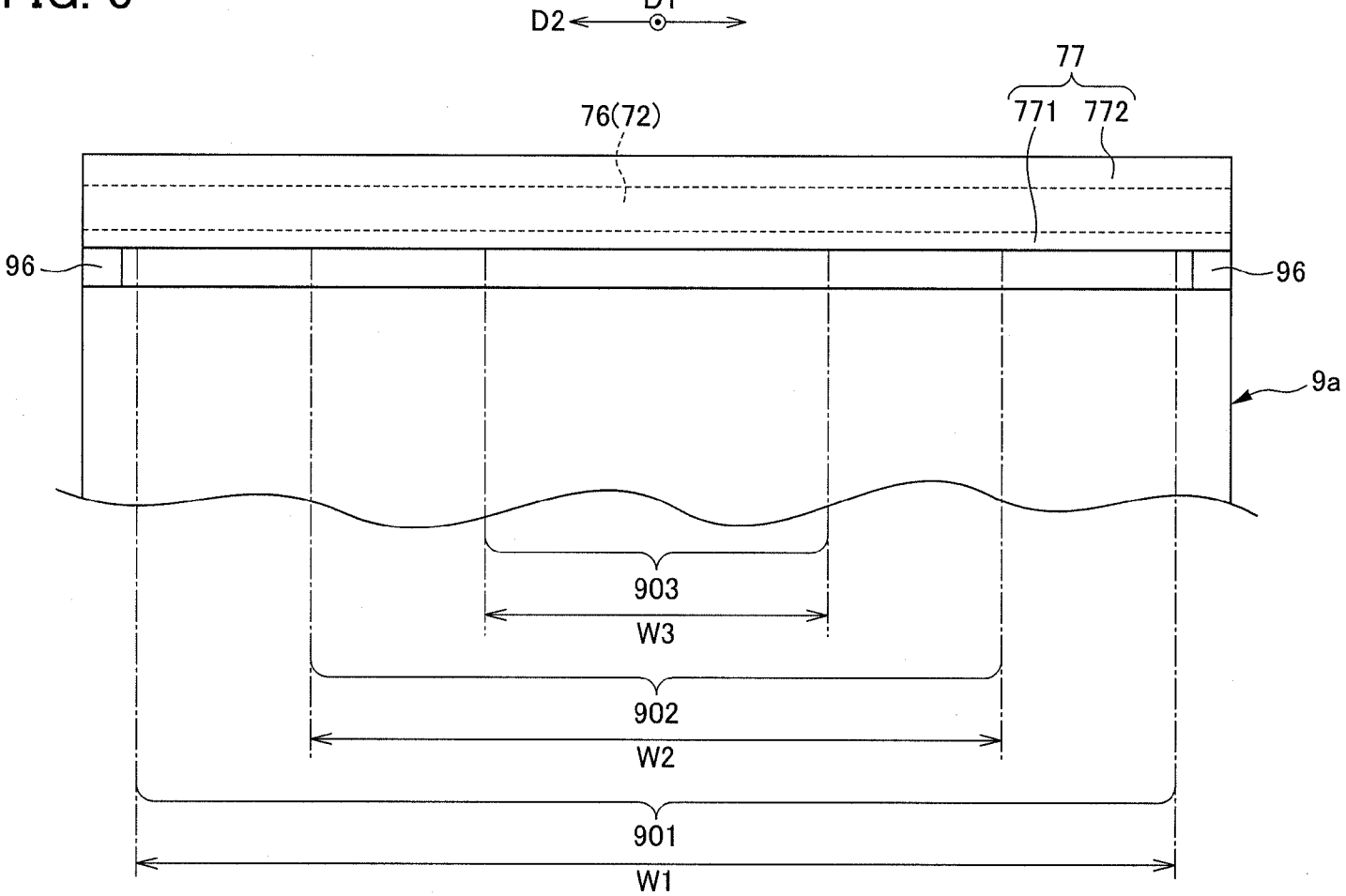
FIG. 3 is a view of a regulating portion and a supporting member of a induction coil of the fixing unit illustrated in FIG. 2 as seen from the conveyance direction of a sheet of paper.

Next, the configuration of the fixing unit 9 that is the characteristic unit of the printer 1 according to the first embodiment will be described in detail. FIG. 2 is a sectional view illustrating the respective constituent elements in the fixing unit 9 in the printer 1 according to the first embodiment. FIG. 3 is a view of the regulating portion 96 and the supporting member 77 of the induction coil 71 of the fixing unit 9 illustrated in FIG. 2 as seen from the conveyance direction D1 of the sheet of paper T.

As illustrated in FIG. 2, the fixing unit 9 includes a heating rotary belt 9*a*, a pressing roller 9*b* as a pressing rotor in pressing contact (abutment) with the heating rotary belt 9*a*, the heating unit 70, a pressing member 92 and a plurality of temperature sensors 95.

The heating rotary belt 9*a* has a circular (endless belt) shape. The heating rotary belt 9*a* is a belt that has a small heat capacity. The heating rotary belt 9*a* can rotate in a first peripheral direction R1 about a second rotational axis J2 that is parallel to a sheet width direction D2. In the present embodiment, the orthogonal direction D2 that is orthogonal to the first peripheral direction R1 is termed "the sheet width direction D2". The heating rotary belt 9*a* uses the heating unit 70 described below to generate heat by induction heating (IH) that employs magnetic induction.

The heating rotary belt 9*a* is disposed in a region where the magnetic flux generated by the induction coil 71 of the heating unit 70 described below passes. In this manner, the heating rotary belt 9*a* forms a magnetic path for the magnetic flux generated by the induction coil 71 of the heating unit 70.

The pressing member 92 is disposed in an inner portion of the heating rotary belt 9*a*. The heating rotary belt 9*a* is suspended on the pressing member 92. The pressing member 92 abuts near the pressing roller 9*b* described below (in a lower inner portion of the heating rotary belt 9*a* in the vertical direction) on an inner peripheral surface (inner surface) of the heating rotary belt 9*a*.

The heating rotary belt 9*a* includes a base layer (not illustrated) formed from a magnetic metal layer, an elastic layer formed on the surface of the base layer (not illustrated), and a surface release layer (not illustrated). An eddy current (induced current) is generated in the heating rotary belt 9*a* by electromagnetic induction from a magnetic flux passing through the base layer of the heating rotary belt 9*a* without penetrating the base layer of the heating rotary belt 9*a*. A Joule heat is generated by electrical resistance of the heating rotary belt 9*a* by passing the eddy current through the heating rotary belt 9*a*. In this manner, the heating rotary belt 9*a* generates heat by reason of an induction heating method (IH) using electromagnetic induction effected by the heating unit 70 described below. In the present embodiment, the base layer is formed from nickel (Ni) having a thickness of 30-50 μm. The elastic layer is formed from silicon rubber having a thickness of several hundred μm. The surface release layer is a tube formed from PFA (tetrafluoroethylene-perfluoro alkyl vinyl ether copolymer) having a thickness of tens of μm.

The pressing roller 9*b* has a cylindrical shape (annular shape). The pressing roller 9*b* is disposed facing the heating rotary belt 9*a* on the lower vertical side of the heating rotary belt 9*a*. The pressing roller 9*b* can rotate in a second peripheral direction R2 about the first rotation axis J1 that is parallel to the sheet width direction D2. The pressing roller 9*b* extends in the first rotation axis J1 direction.

The outer peripheral surface of the pressing roller 9*b* is disposed to abut with the outer peripheral surface (external surface) of the heating rotary belt 9*a*. The pressing roller 9*b* is disposed to press the pressing member 92 though the heating rotary belt 9*a*. The pressing roller 9*b* sandwiches a portion of the heating rotary belt 9*a* with the pressing member 92 to thereby form a fixing nip F with the heating rotary belt 9*a*. The sheet of paper T is sandwiched and conveyed at the fixing nip F.

The heating rotary belt 9*a* is subjected to an upward pressing force by the pressing roller 9*b* and the pressing member 92 (described below) in the direction (vertical direction) of the plane connecting the second rotation axis J2 of the heating rotary belt 9*a* and the pressing member 92. In this manner, a force that expands the heating rotary belt 9*a* outwardly acts on the heating rotary belt 9*a* in a direction that is orthogonal to the plane that connects the second rotation axis J2 of the heating rotary belt 9*a* and the pressing member 92.

The pressing roller 9*b* includes a pressing roller main body 941 and a pair of axial members 942 coaxial to the first rotation axis J1. The pressing roller main body 941 includes a cylindrical core member, an elastic layer formed on an outer peripheral surface of the core member, and a release layer formed on an outer peripheral surface of the elastic layer. In the present embodiment, iron is used in the core member. Furthermore, foamed silicone rubber is used in the elastic layer. A PFA tube is used in the release layer.

A rotation drive unit (not illustrated) for driving to rotate the pressing roller 9*b* is connected to one of the axial member 942 of the pressing rollers 9*b*. The pressing roller 9*b* is driven to rotate at a predetermined speed by the rotation drive unit. The heating rotary belt 9*a* in abutment with the outer peripheral surface of the pressing roller 9*b* is rotated in response to the rotation of the pressing roller 9*b* by the rotation and driving action of the rotation drive unit.

The pressing member 92 is disposed in an inner portion of the heating rotary belt 9*a*. The portion that abuts with the inner peripheral surface of the heating rotary belt 9*a* of the pressing member 92 is formed from a low-friction layer such as porous glass cloth sheet or the like.

The pressing member 92 extends along the sheet width direction D2. The pressing member 92 abuts with the inner peripheral surface of the heating rotary belt 9*a* near the pressing roller 9*b* on the inner portion of the heating rotary belt 9*a*. The pressing member 92 sandwiches the heating rotary belt 9*a* with the pressing roller 9*b* to form a fixing nip F between the heating rotary belt 9*a* and the pressing roller 9*b*. The low-friction layer of the pressing member 92 makes sliding contact with the inner peripheral surface of the heating rotary belt 9*a*.

When the sheet of paper T conveyed to the fixing nip F is conveyed and passes through the paper passing region of the fixing unit 9, the toner image is fixed on the sheet of paper T. As used herein "paper passing region" is the region through which a sheet of paper T conveyed to the fixing nip F passes in a configuration of being sandwiched by the heating rotary belt 9*a* and the pressing roller 9*b*. Furthermore, when the sheet of paper T is conveyed to the fixing nip F, the region on the outer side of the paper passing region through which the sheet of paper T does not pass is termed the "non-paper passing region"

As illustrated in FIG. 3, a maximum paper passing region 901 is set on the outer peripheral surface of the heating rotary belt 9*a* as a paper passing region through which a sheet of paper T corresponding to the maximum length of the sheet width direction D2 (maximum width) passes when the sheet of paper T is conveyed to the fixing nip F. The length in a direction parallel to the sheet width direction D2 of the maximum paper passing region 901 is termed the "maximum paper passing width W1".

A minimum paper passing region 903 is set on the outer peripheral surface of the heating rotary belt 9*a* as a paper passing region through which a sheet of paper T corresponding to the minimum length of the sheet width direction D2 (minimum width) passes when the sheet of paper T is conveyed to the fixing nip F. The length in a direction parallel to the sheet width direction D2 of the minimum paper passing region 903 is termed the "minimum paper passing width W3".

An intermediate paper passing region 902 is set on the outer peripheral surface of the heating rotary belt 9*a* as a paper passing region through which a sheet of paper T that has a length in the sheet width direction D2 corresponding to an intermediate length that is shorter than the maximum length and longer than the minimum length (intermediate width) passes when the sheet of paper T is conveyed to the fixing nip F. The length in a direction parallel to the sheet width direction D2 of the intermediate paper passing region 902 is termed the "intermediate paper passing width W2".

The paper passing regions for the sheets of paper T are not limited thereby and may be suitably set corresponding to the size of the sheets of paper T. Furthermore, a pressure-side maximum paper passing region, a pressure-side minimum paper passing region and a pressure-side intermediate paper passing region are set on the outer peripheral surface of the pressing roller 9*b* corresponding to the maximum paper passing region 901, the minimum paper passing region 903 and the intermediate paper passing region 902 of the heating rotary belt 9*a*, respectively. However, each of these regions is omitted from the figures.

Next, the heating unit 70 will be described. As illustrated in FIG. 2 and FIG. 3, the heating unit 70 includes the induction coil 71, a magnetic core portion 72, a supporting member 77 for supporting the induction coil 71, and a regulating portion 96.

The induction coil 71 is separated from the outer peripheral surface of the heating rotary belt 9*a* by a predetermined distance, and is disposed along the outer peripheral surface of the heating rotary belt 9*a*. In the present embodiment, the pre-wound induction coil 71 is disposed on the heating unit 70 so that a longitudinal direction thereof is parallel to the sheet width direction D2.

The induction coil 71 may be formed by winding wire in an elongated configuration with reference to the sheet width direction D2 viewed in plan (when seen from above FIG. 2).

The induction coil 71 is formed to be longer than the length of the heating rotary belt 9*a* in the sheet width direction D2.

When the induction coil 71 is disposed on the heating unit 70, the induction coil 71 are formed so that the disposition described below is realized. In other words, the inner peripheral edge of the induction coil 71 (the position at which the wire 711A is disposed) enclose a central region 718. The wire configuring the induction coil 71 extend in the sheet width direction D2. Furthermore, the wire configuring the induction coil 71 is aligned from the inner peripheral edge of the induction coil 71 in the peripheral direction of the heating rotary belt 9*a*. The outer peripheral edge of the induction coil 71 (the position at which the wire 711B is disposed) faces the outer peripheral surface of the heating rotary belt 9*a*.

The supporting member 77 is separated from the heating rotary belt 9*a* facing the heating rotary belt 9*a* on an upper side in a vertical direction of the heating rotary belt 9*a*. The supporting member 77 is formed in an arcuate configuration along the outer peripheral surface of the heating rotary belt 9*a* on an upper side in a vertical direction of the heating rotary belt 9*a*. The arcuate portion of the supporting member 77 extends in a range of approximately 180° in an angle about the second rotation axis J2 of the heating rotary belt 9*a*. The supporting member 77 is elongated in the sheet width direction D2, and has a length that is substantially the same as the length of the sheet width direction D2 of the induction coil 71.

The supporting member 77 includes a holding portion 771 and a cover portion 772. When the holding portion 771 and the cover portion 772 are viewed from the sheet width direction D2, the holding portion 771 and the cover portion 772 are formed from a plate member curving in an arcuate configuration.

The holding portion 771 is disposed facing the outer peripheral surface of the heating rotary belt 9*a* on the side of the heating rotary belt 9*a* relative to the induction coil 71. The holding portion 771 supports the induction coil 71 to be retained at a predetermined position.

The cover portion 772 is disposed on the opposite side of the heating rotary belt 9*a* relative to the induction coil 71. The cover portion 772 is disposed to cover the induction coil 71.

The induction coil 71 is connected to an induction heating circuit (not illustrated). An alternating current from the induction heating circuit is applied to the induction coil 71. The induction coil 71 generates a magnetic flux to thereby generate heat in the base layer of the heating rotary belt 9*a* by application of an alternating current from the induction heating circuit. For example, an alternating current having a frequency of the level of 30 kHz is applied to the induction coil 71.

The magnetic flux generated by the induction coil 71 is introduced into the magnetic path that is the path for magnetic flux formed by the magnetic core portion 72 (described below) and the heating rotary belt 9*a*.

The magnetic path is formed by the magnetic core portion 72 (described below) and the heating rotary belt 9*a* so that the magnetic flux generated by the induction coil 71 revolves in a revolving direction R3. The revolving direction R3 is a direction passing along the inner side of the inner peripheral edge 711A and the outer side of the outer peripheral edge 711B of the induction coil 71 to thereby revolve about a portion of the wire of the induction coil 71. The magnetic flux generated by the induction coil 71 passes through the magnetic path.

The magnetic flux generated by the induction coil 71 changes both its intensity and direction due to positive or negative periodic fluctuation of the alternating current since an alternating current is applied from the induction heating circuit (not illustrated). An induction current (eddy current) is generated in the heating rotary belt 9*a* by changes in the magnetic flux.

The magnetic core portion 72 configures a magnetic path that revolves in the revolving direction R3 as illustrated in FIG. 2. The magnetic core portion 72 is disposed in a region for passage of the magnetic flux generated by induction coil 71 and is mainly formed from a ferromagnetic material. As a result, a magnetic path is configured to form a path for magnetic flux generated by the induction coil 71.

The magnetic core portion 72 includes a center core portion 73, and a pair of side core portions 76.

When viewed in the sheet width direction D2, the center core portion 73 is disposed in a substantially center position of the heating rotary belt 9*a* with reference to the conveyance direction D1 of the sheet of paper T on an upper side (in proximity to the central region 718) in the vertical direction of the heating rotary belt 9*a*.

As illustrated in FIG. 2, the center core portion 73 forms a magnetic path with the heating rotary belt 9*a* in the revolving direction R3 of the magnetic path. The center core portion 73 is disposed in proximity to the central region 718 (in proximity to the inner peripheral edge 711A of the induction coil 71).

The center core portion 73 is separated from the outer peripheral surface of the heating rotary belt 9*a* by only a predetermined distance and faces the outer peripheral surface of the heating rotary belt 9*a*. The center core portion 73 includes a first opposed surface 731 facing the outer peripheral surface of the heating rotary belt 9*a* without sandwiching the induction coil 71 therebetween.

Furthermore, the center core portion 73 is formed in substantially a rectangular parallelepiped shape that is elongated with respect to the sheet width direction D2. The center core portion 73 is formed in the sheet width direction D2 to be longer than the region corresponding to the maximum paper passing region 901.

As illustrated in FIG. 2, the pair of side core portions 76 forms a magnetic path with the center core portion 73 in the revolving direction R3 of the magnetic path. The pair of side core portions 76 is aligned with the center core portion 73 in the revolving direction R3 of the magnetic path.

The pair of side core portions 76 is disposed in proximity to the outer peripheral edge 711B of the induction coil 71. The pair of side core portions 76 is separated from the outer peripheral surface of the heating rotary belt 9*a* by only a predetermined distance and faces the outer peripheral surface of the heating rotary belt 9*a*. The pair of side core portions 76 includes a second opposed surface 761 facing the outer peripheral surface of the heating rotary belt 9*a* without sandwiching the induction coil 71 therebetween. Furthermore, the pair of side core portions 76 is formed in substantially a rectangular parallelepiped shape that is elongated with respect to the sheet width direction D2.

The pair of side core portions 76 is formed in the sheet width direction D2 to be longer than the region corresponding to the maximum paper passing region 901.

Next, the regulating portions 96 will be described. The regulating portions 96 abut with the outer peripheral surface of the heating rotary belt 9*a*. In this manner, the regulating portions 96 regulate the deformation of the heating rotary belt 9*a* so that the distance between the induction coil 71 and the outer peripheral surface of the heating rotary belt 9*a* is constant. As illustrated in FIG. 3, the regulating portions 96 are disposed in proximity to both ends in the sheet width direction D2 of the supporting member 77. The regulating portions 96 are fixed to the supporting member 77. The regulating portions 96 are formed to project from the supporting member 77 towards the heating rotary belt 9*a*.

As illustrated in FIG. 2, in the first embodiment, each of the regulating portions 96 is formed by an arcuate first rib 961. Each of the arcuate first rib 961 extends in the first peripheral direction R1 along the outer peripheral surface of the heating rotary belt 9*a*. The amount of projection of the first rib 961 is set in consideration of the distance between the induction coil 71 and the outer peripheral surface of the heating rotary belt 9*a*.

As illustrated in FIG. 2 and FIG. 3, each of the first rib 961 abuts with the outer peripheral surface of the heating rotary belt 9*a* along substantially half the circumference of the outer peripheral surface thereof on an upper side in a vertical direction on the heating rotary belt 9*a* in the non-paper passing region on the outer side of the maximum paper passing region 901. More specifically, each of the first rib 961 is formed to extend in a range of approximately 180° in an angle about the second rotation axis J2 of the heating rotary belt 9*a* on an upper side from the center portion in a vertical direction on the heating rotary belt 9*a*. each of the first rib 961 abuts with and along the outer peripheral surface of the heating rotary belt 9*a*. Each of the first rib 961 is formed continuously from the upstream side of the first peripheral direction R1 of the heating rotary belt 9*a* (one side) to the downstream side (other side) in a symmetrical configuration to the plane connecting the pressing member 92 with the second rotation axis J2 of the heating rotary belt 9*a*.

In this manner, each of the first rib 961 regulates the deformation of the heating rotary belt 9*a* in a direction that is orthogonal to the plane connecting the second rotation axis J2 of the heating rotary belt 9*a* and the pressing member 92. At the same time, each of the first rib 961 regulates the position of the upper portion in a vertical direction of the heating rotary belt 9*a* relative to the supporting member 77. Thus each of the first rib 961 makes the distance between the induction coil 71 and the outer peripheral surface of the heating rotary belt 9*a* constant.

As illustrated in FIG. 2, the end 961*a* of the first rib 961 on the upstream side (downstream side of the conveyance direction D1 of the sheet of paper T) in the first peripheral direction R1 abuts with the outer peripheral surface of the heating rotary belt 9*a* after gradually approaching the outer peripheral surface of the heating rotary belt 9*a* from the upstream side of the first peripheral direction R1 towards a downstream side. Each of the end 961*b* on the downstream side (upstream side of the conveyance direction D1 of the sheet of paper T) of the first peripheral direction R1 of the first rib 961 abuts in a substantially vertical configuration with the outer peripheral surface of the heating rotary belt 9*a*.

The temperature sensors 95 detect the temperature of the outer peripheral surface of the heating rotary belt 9*a*. The temperature sensor 95 is disposed in a configuration of facing but not making contact with the outer peripheral surface of the heating rotary belt 9*a*.

Next, the operation of the printer 1 including the fixing unit 9 according to the present embodiment will be described.

Firstly, when the power source of the printer 1 is switched to the ON position, power is supplied respectively to the charging units 10*a*, 10*b*, 10*c* and 10*d*, the laser scanner units 4*a*, 4*b*, 4*c* and 4*d*, the developing units 16*a*, 16*b*, 16*c* and 16*d*, the primary transfer rollers 37*a*, 37*b*, 37*c* and 37*d*, the secondary transfer roller 8, the printer control unit (not illustrated), and the fixing unit 9. Control signals from the printer control unit are used in the controls of the respective operation of the charging units 10*a*, 10*b*, 10*c* and 10*d*, the laser scanner units 4*a*, 4*b*, 4*c* and 4*d*, the developing units 16*a*, 16*b*, 16*c* and 16*d*, the primary transfer rollers 37*a*, 37*b*, 37*c* and 37*d*, the secondary transfer roller 8, the intermediate transfer belt 7, and the fixing unit 9.

The reception unit (not illustrated) of the printer 1 receives image formation instruction information when the power source of the printer 1 is in the ON position. The image formation instruction information is information generated based on the operation of an operation unit (not illustrated) that is disposed, for example, in an external portion of the printer 1.

Next, the printer 1 starts the printing operation.

More specifically, the sheet of paper T that is fed from the pair of registration rollers 80 passes through the first conveyance path L1 and is conveyed to the transfer nip N2 between the intermediate transfer belt 7 and the secondary transfer roller 8. When the sheet of paper T is conveyed in this manner to the transfer nip N2, the charging units 10*a*, 10*b*, 10*c* and 10*d* negatively charges (negative polarity) or positively charges (positive polarity) the surface of each of the photoreceptor drums 2*a*, 2*b*, 2*c* and 2*d* in a uniform manner, respectively. The laser scanner units 4*a*, 4*c*, 4*c* and 4*d* irradiate laser light from a laser light source (not illustrated) toward the respective photoreceptor drums 2*a*, 2*b*, 2*c* and 2*d*. The laser scanner units 4*a*, 4*b*, 4*c* and 4*d* perform scanning exposure of the surface of each of the photoreceptor drums 2*a*, 2*b*, 2*c* and 2*d*, and then the charge is removed. In this manner, an electrostatic latent image is formed on the respective surfaces of the photoreceptor drums 2*a*, 2*b*, 2*c* and 2*d*.

Then, the developing units 16*a*, 16*b*, 16*c* and 16*d* causes a toner of respective colors to adhere to the electrostatic latent image formed on the surface of each of the photoreceptor drums 2*a*, 2*b*, 2*c* and 2*d*, thereby forming a color toner image on the surface of each of the photoreceptor drums 2*a*, 2*b*, 2*c* and 2*d*. Then, a toner image of each color, which is formed on each of the photoreceptor drums 2*a*, 2*b*, 2*c* and 2*d*, is sequentially subjected to the primary transfer to the intermediate transfer belt 7. In this manner, a full color toner image is formed on the intermediate transfer belt 7.

Then the toner image is transferred onto the sheet of paper T that passes through the transfer nip N2 between the intermediate transfer belt 7 and the secondary transfer roller 8. The sheet of paper T with the transferred toner image is conveyed through the second conveyance path L2 towards the fixing unit 9. More specifically, the sheet of paper T with the transferred toner image is conveyed towards the fixing nip F that is formed by the heating rotary belt 9*a* and the pressing roller 9*b* of the fixing unit 9.

When power supply to the drive control unit of the fixing unit 9 is started, the pressing roller 9*b* is driven to rotate by the rotating drive unit (not illustrated). The heating rotary belt 9*a* is driven to rotate by the rotation of the pressing roller 9*b*.

Then the fixing unit 9 commences a heat generation operation.

In this manner, an alternating current is applied to the induction coil 71 from the induction heating circuit (not illustrated). The induction coil 71 generates a magnetic flux, thereby generating heat in the heating rotary belt 9*a*.

The magnetic flux generated by the induction coil 71 passes (revolves) through the revolving direction R3 to connect the inner side of the inner peripheral edge 711A and the outer side of the outer peripheral edge 711B of the induction coil 71 in the magnetic path that is formed by the heating rotary belt 9*a*, the center core portion 73 and the pair of side core portions 76.

An eddy current (induction current) is generated by electromagnetic induction in the base layer of the heating rotary belt 9*a* due to variations in the direction and the intensity of the magnetic flux passing through the magnetic path. The eddy current passes through the base layer of the heating rotary belt 9*a* to thereby generate Joule heat because the base layer of the heating rotary belt 9*a* has its electrical resistance and, as a result, the heating rotary belt 9*a* generates heat.

Next, the rotation of the heating rotary belt 9*a* displaces the portion (base layer) that is heated by electromagnetic induction heating (IH) in the heating rotary belt 9*a* in a sequential manner toward the fixing nip F formed by the heating rotary belt 9*a* and the pressing roller 9*b* of the fixing unit 9. The printer 1 controls the induction heating circuit (not illustrated) so that temperature at the fixing nip F becomes a predetermined temperature.

The sheet of paper T with the toner image is introduced into the fixing nip F of the fixing unit 9. In this manner, the toner is melted in the fixing nip F to thereby fixing the toner to the sheet of paper T.

During the fixing operation by the fixing unit 9, a pressing force is applied to the heating rotary belt 9*a* in an upward vertical direction as a result of the pressing member 92 that abuts with the inner peripheral surface of the heating rotary belt 9*a* and the annular pressing roller 9*b* that is disposed facing the heating rotary belt 9*a*. In this manner, a force that expands the heating rotary belt 9*a* outwardly acts on the heating rotary belt 9*a* in a direction that is orthogonal to the plane that connects the second rotation axis J2 of the heating rotary belt 9*a* and the pressing member 92.

In the present embodiment, the regulating portions 96 are formed by the arcuate first ribs 961 as described above. The first ribs 961 are formed across the upstream side of the first peripheral direction R1 of the heating rotary belt 9*a* (one side) to the downstream side (other side) in a symmetrical configuration to the plane connecting the central portion of pressing member 92 with respect to the conveyance direction D1 of the sheet of paper T with the second rotation axis J2 of the heating rotary belt 9*a*. In this manner, the first ribs 961 abut with the outer peripheral surface of the heating rotary belt 9*a* to thereby sandwich the heating rotary belt 9*a* from the upstream and downstream sides with respect to the conveyance direction D1 of the sheet of paper T The first ribs 961 regulate the deformation of the heating rotary belt 9*a*.

The arcuate first ribs 961 abut along the outer peripheral surface of the heating rotary belt 9*a* on an upper side from the central portion in a vertical direction on the heating rotary belt 9*a*. Consequently, each of the first rib 961 regulates the deformation of the heating rotary belt 9*a* and regulates the position of the portion in an upward vertical direction of the heating rotary belt 9*a* so that the distance between the outer peripheral surface of the heating rotary belt 9*a* and the induction coil 71 becomes constant. In this manner, the heating efficiency of the fixing unit 9 is stabilized. Furthermore, the heating time during startup of the fixing unit 9 can be stabilized.

The regulating portions 96 abut with the heating rotary belt 9*a* in the non-paper passing region on the outer side of the maximum paper passing region 901. As a result, heat loss by the regulating portions 96 in the paper passing region of the heating rotary belt 9*a* can be suppressed and the regulating portion 96 can stabilize the heating efficiency of the fixing unit 9. Furthermore, the startup time of the fixing unit 9 can be stabilized.

The upstream end 961*a* of the arcuate first ribs 961 in the first peripheral direction R1 gradually approach the outer peripheral surface of the heating rotary belt 9*a* from the upstream side of the first peripheral direction R1 of the heating rotary belt 9*a* towards the downstream side. As a result, catching of the heating rotary belt 9*a* on the end 961*a* of the regulating portion 96 during rotation is reduced. As a result, the regulating portions 96 abut in a configuration in which almost no damage is caused to the heating rotary belt 9*a*. Therefore, the regulating portions 96 can rotate the heating rotary belt 9*a* smoothly.

The printer 1 according to the present embodiment includes the arcuate heating rotary belt 9*a*, the pressing member 92 that abuts with the inner surface of the heating rotary belt 9*a*, the pressing roller 9*b* that forms the fixing nip F with the heating rotary belt 9*a*, the induction coil 71 that is disposed with a predetermined distance from the outer peripheral surface of the heating rotary belt 9*a* and generate a magnetic flux to generate heat in the heating rotary belt 9*a*, the magnetic core portion 72 that forms a magnetic path for magnetic flux generated by the induction coil 71, and a first ribs 961 that regulate the deformation of the heating rotary belt 9*a* by abutment with the outer peripheral surface of the heating rotary belt 9*a*. As a result, deformation of the heating rotary belt 9*a* is regulated with a simple configuration. In this manner, the distance between the induction coil 71 and the outer peripheral surface of the heating rotary belt 9*a* can become constant. Therefore, the heating efficiency of the fixing unit 9 can be stabilized. As a result, the startup time of the fixing unit 9 can be stabilized.

The first ribs 961 in the printer 1 according to the present embodiment are disposed on the supporting member 77. As a result, the deformation of the heating rotary belt 9*a* is regulated with a simple configuration in which only the first ribs 961 are provided on the supporting member 77.

The projection amount of the first rib 961 in the printer 1 according to the present embodiment is set in consideration of the distance between the induction coil 71 and the outer peripheral surface of the heating rotary belt 9*a*. Consequently, a heating design for the fixing unit 9 is easily enabled by simply adjusting the projection amount of the first rib 961. In this manner, the heating efficiency of the fixing unit 9 can be stabilized. As a result, the startup time of the fixing unit 9 can be stabilized.

Next, a second embodiment of the present disclosure will be described. In the second embodiment, the description will be done mainly about differences from the first embodiment, and those elements of configuration that are the same as the first embodiment are denoted by the same reference numerals and detailed description thereof will be omitted. The description of the first embodiment can be suitably applied or supplemented in relation to those points of the second embodiment for which particular description is not provided.

Figure 4:
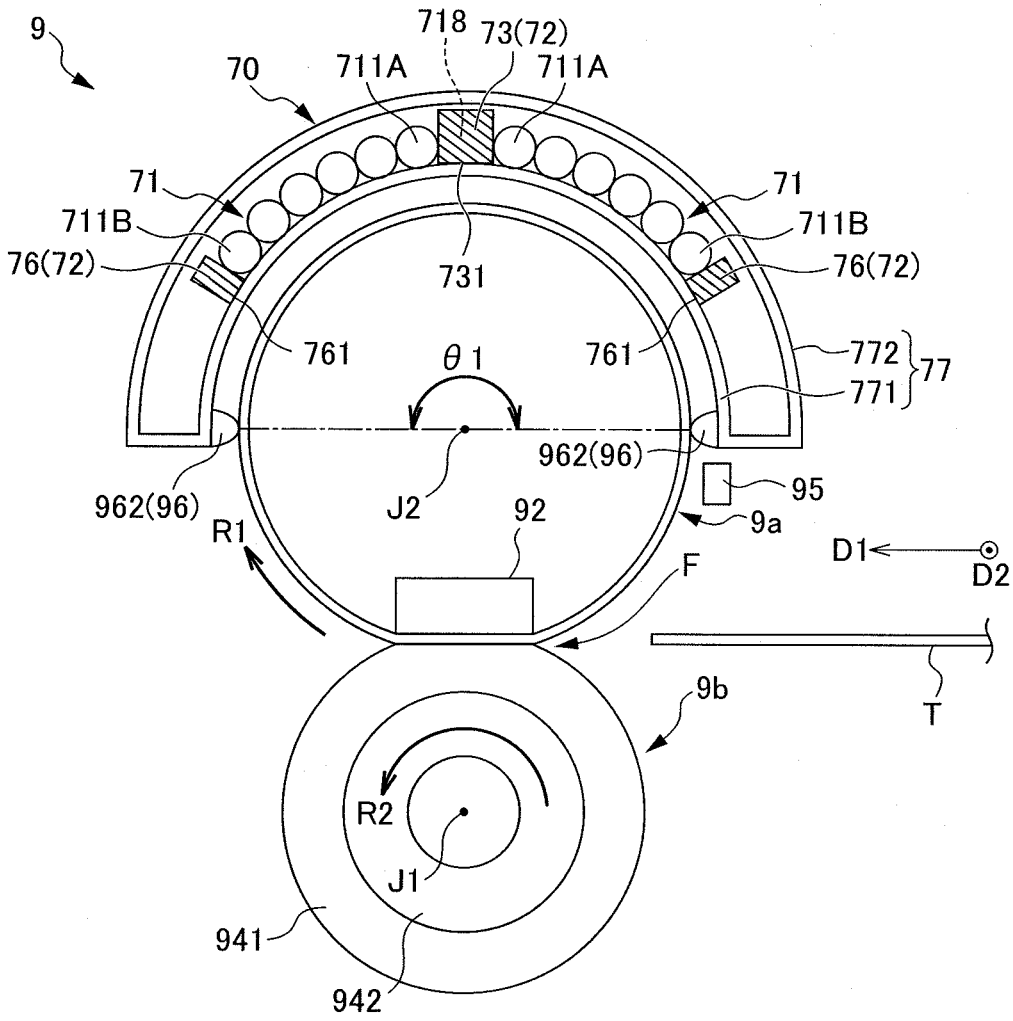
FIG. 4 is a sectional view illustrating respective constituent elements of a fixing unit in a printer 1 according to a second embodiment of the present disclosure.
Figure 5:
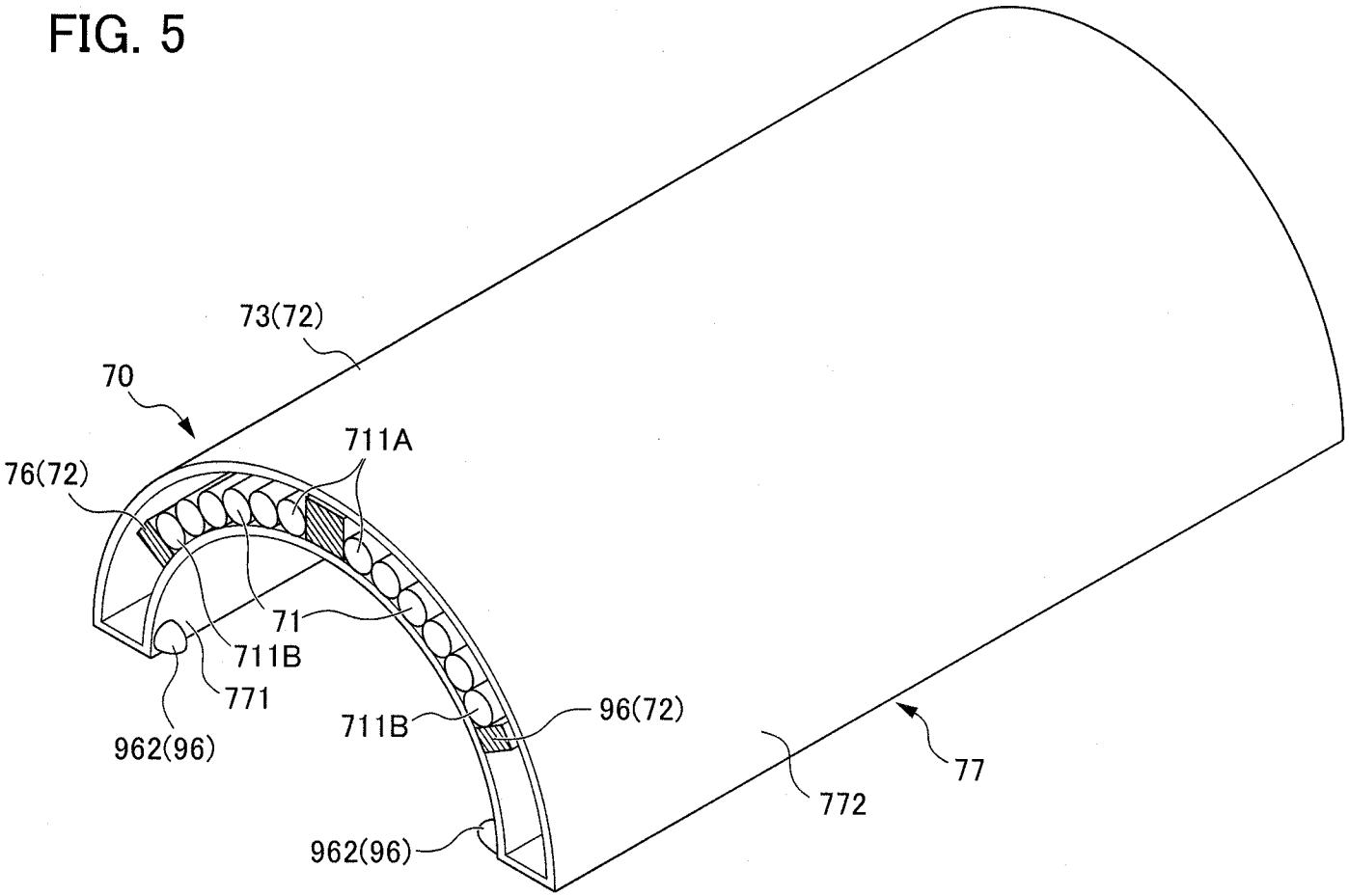
FIG. 5 is a perspective view of a heating unit of the fixing unit illustrated in FIG. 4.

FIG. 4 is a sectional view illustrating respective constituent elements of the fixing unit 9 in the printer 1 according to the second embodiment of the present disclosure. FIG. 5 is a perspective view of the heating unit 70 of the fixing unit 9 illustrated in FIG. 4.

In the second embodiment, the shape of the regulating portion 96 and the position of the regulating portion 96 largely differ from the first embodiment.

As illustrated in FIG. 4 and FIG. 5, each of the regulating portion 96 in the second embodiment includes two substantially hemispherical second ribs 962. The two second ribs 962 are disposed in proximity to both ends in the sheet conveyance direction D1 of the supporting member 77 of the heating unit 70. The two second ribs 962 are integrally formed with the supporting member 77. The hemispherical tip portion of the two second ribs 962 abuts with the outer peripheral surface of the heating rotary belt 9*a* in the non-paper passing region on the outer side of the maximum paper passing region 901.

The two second ribs 962 are separately disposed at the upstream side of the first peripheral direction R1 (one side) and at the downstream side (other side) in a symmetrical configuration to the plane connecting the pressing member 92 with the second rotation axis J2 of the heating rotary belt 9*a*. The two second ribs 962 are separately disposed each other in a direction that is substantially orthogonal to the plane connecting the pressing member 92 with the second rotation axis J2 of the heating rotary belt 9*a*.

The two second ribs 962 are disposed with a separation of substantially 180° in an angle θ1 centering on the second rotation axis J2 of the heating rotary belt 9*a* on the side of the induction coil 71 with respect to the outer peripheral surface of the heating rotary belt 9*a*. As a result, the two second ribs 962 abut with a portion that is associated with a high probability of maximum deformation of the heating rotary belt 9*a*.

The two second ribs 962 abut with the outer peripheral surface of the heating rotary belt 9*a* to press the central portion in a vertical direction of the heating rotary belt 9*a* towards the inner side of the heating rotary belt 9*a* and thereby sandwich the heating rotary belt 9*a* from the upstream and downstream side in the conveyance direction D1 of the sheet of paper T. In this manner, the two second ribs 962 regulate the position of the heating rotary belt 9*a* with respect to the supporting member 77 by regulating the deformation of the heating rotary belt 9*a*. Therefore, the two second ribs 962 can keep the distance between the induction coil 71 supported by the supporting member 77 and the outer peripheral surface of the heating rotary belt 9*a* constant. In this manner, the heating efficiency of the fixing unit 9 is stabilized. Furthermore, the heating time during startup of the fixing unit 9 can be stabilized.

By using the printer 1 according to the second embodiment, the following effects can be obtained in addition to the effects exhibited by the first embodiment.

The regulating portion 96 in the fixing unit 9 of the printer 1 according to the second embodiment is configured by two substantially hemispherical ribs 962. The two second ribs 962 are separately disposed each other in a direction that is substantially orthogonal to the plane connecting the pressing member 92 with the second rotation axis J2 of the heating rotary belt 9*a*. As a result, the two second ribs 962 press the central portion in a vertical direction of the heating rotary belt 9*a* towards the inner side of the heating rotary belt 9*a* and thereby sandwich the heating rotary belt 9*a* from the upstream and downstream side in the conveyance direction D1 of the sheet of paper T. In this manner, the two second ribs 962 can stably regulate the deformation of the heating rotary belt 9*a*. Therefore, the distance between the induction coil 71 and the outer peripheral surface of the heating rotary belt 9*a* can be kept constant.

The two second ribs 962 are disposed with a separation of substantially 180° in an angle θ1 centering on the second rotation axis J2 of the heating rotary belt 9*a* on the side of the induction coil 71 with respect to the outer peripheral surface of the heating rotary belt 9*a*. As a result, the two second ribs 962 abut with a portion that is associated with a high probability of maximum deformation of the heating rotary belt 9*a*. In this manner, the two second ribs 962 can further regulate the deformation of the heating rotary belt 9*a*. In this manner, the heating efficiency of the fixing unit 9 is further stabilized. Furthermore, the heating time during startup of the fixing unit 9 can be further stabilized.

The spherical tip of the two second ribs 962 abuts with the outer peripheral surface of the heating rotary belt 9*a*. As a result, the distance between the induction coil 71 and the outer peripheral surface of the heating rotary belt 9*a* can be kept constant in a configuration in which damage such as marking of the heating rotary belt 9*a* by contact with the two second rib 962 is reduced.

Next, a third embodiment of the present disclosure will be described. In the third embodiment, the description will be done mainly about differences from the first embodiment and the second embodiment, and those elements of configuration that are the same as the first embodiment and the second embodiment are denoted by the same reference numerals and detailed description thereof will be omitted. The description of the first embodiment and the second embodiment can be suitably applied or supplemented in relation to those points of the third embodiment for which particular description is not provided.

Figure 6:
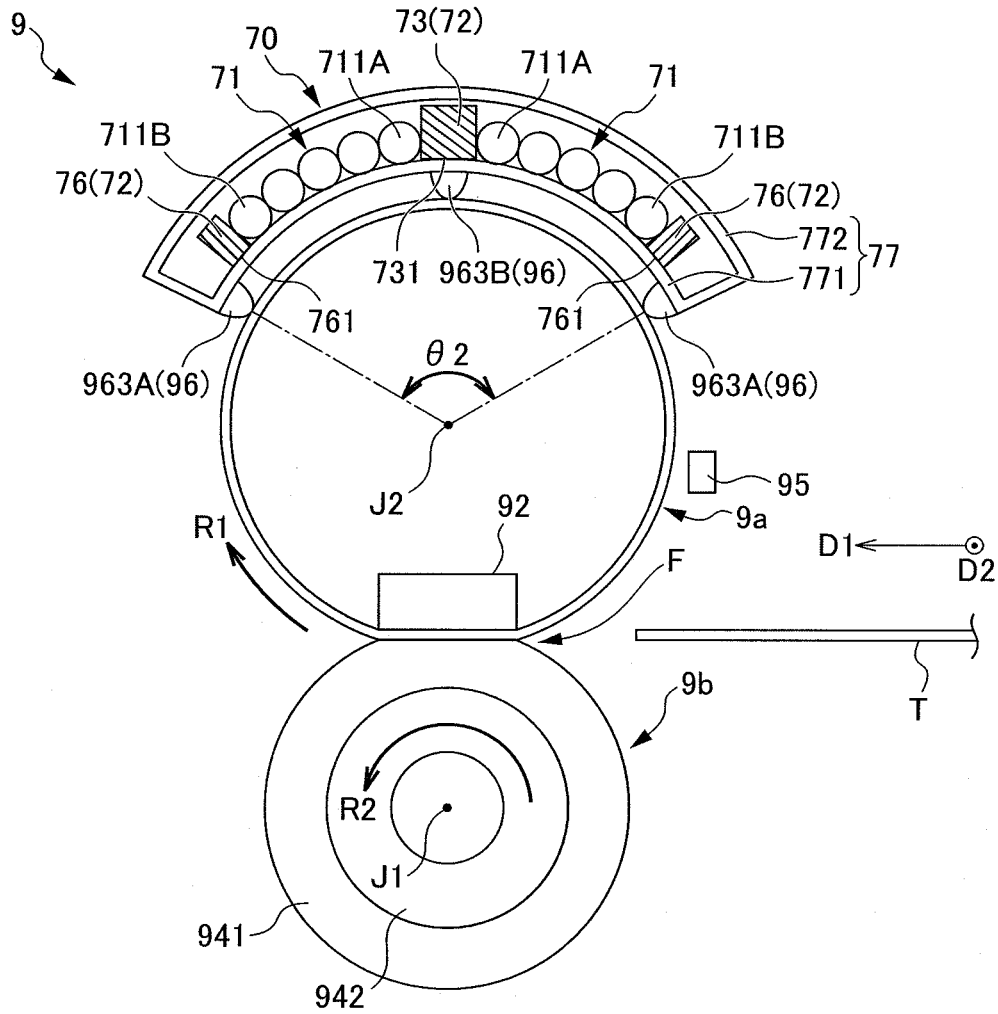
FIG. 6 is a sectional view illustrating respective constituent elements of a fixing unit in a printer according to a third embodiment of the present disclosure.

FIG. 6 is a sectional view illustrating respective constituent elements of the fixing unit 9 in the printer 1 according to the third embodiment of the present disclosure.

The main difference of the third embodiment in relation to the second embodiment is that the supporting member 77 of the heating unit 70 is formed in an arcuate shape of approximately 120° in an angle centering on the second rotation shaft J2 of the heating rotary belt 9*a*, and that the regulating portion 96 is configured by hemispherical third ribs 963A, 963A, 963B.

More precisely, the three hemispherical third ribs 963A, 963A, 963B are disposed in a range of approximately 120° in an angle θ2 centering on the second rotation shaft J2 of the heating rotary belt 9*a*. The three third ribs 963A, 963A, 963B are disposed respectively separated on the upstream end, the downstream end and an intermediate position in the first peripheral direction R1 on the holding portion 771 of the supporting member 77. The spherical tip portions of the three substantially hemispherical third ribs 963A, 963A, 963B abut with three positions on the outer peripheral surface of the heating rotary belt 9*a* on the non-paper passing region on the outer side of the maximum paper passing region 901.

The third ribs 963A, 963A are disposed on the upstream end and the downstream end in the first peripheral direction R1 of the holding portion 771 of the supporting member 77. The third ribs 963A, 963A on the upstream end and the downstream end are disposed in a range of approximately 120° in an angle θ2 centering on the second rotation shaft J2 of the heating rotary belt 9*a* on the side of induction coil 71 with respect to the outer peripheral surface of the heating rotary belt 9*a*. As a result, the two third ribs 963A, 963A abut with a portion that is associated with a probability of deformation of the heating rotary belt 9*a*. The third ribs 963A, 963A on the upstream end and the downstream end abut with the outer peripheral surface of the heating rotary belt 9*a* and regulate the deformation of the heating rotary belt 9*a*.

The third rib 963B is disposed at an intermediate position between the upstream end and the downstream end of the holding portion 771 of the supporting member 77. The third rib 963B at the intermediate position abuts with the outer peripheral surface of the heating rotary belt 9*a* in the uppermost portion in the vertical direction of the heating rotary belt 9*a* to regulate the position of the outer peripheral surface of the heating rotary belt 9*a* relative to the supporting member 77.

In addition to the effect obtained by the first embodiment and the second embodiment, by using the printer 1 according to the third embodiment, the following effects can be obtained.

The third ribs 963A, 963A on the upstream end and the downstream end in the fixing unit 9 of the printer 1 according to the third embodiment are separated by approximately 120° in an angle θ2 centering on the second rotation shaft J2 of the heating rotary belt 9*a* on the side of the induction coil 71 with respect to the outer peripheral surface of the heating rotary belt 9*a*. As a result, the two third ribs 963A, 963A abut with the portion of the heating rotary belt 9*a* that deforms. As a result, the two third ribs 963A, 963A abut with the outer peripheral surface of the heating rotary belt 9*a* to regulate the deformation of the heating rotary belt 9*a*. In this manner, the heating efficiency of the fixing unit 9 is stabilized. Furthermore, the heating time during startup of the fixing unit 9 can be stabilized.

Furthermore, the third rib 963B at the intermediate position regulates the position of the outer peripheral surface of the heating rotary belt 9*a* relative to the supporting member 77 between the two third ribs 963A, 963A on the upstream end and the downstream end.

In this manner, the three third ribs 963A, 963A, 963B overall regulate the position of the heating rotary belt 9*a* to thereby keep the distance between the induction coil 71 and the outer peripheral surface of the heating rotary belt 9*a* constant. In this manner, the heating efficiency of the fixing unit 9 is further stabilized. Furthermore, the heating time during startup of the fixing unit 9 can be further stabilized.

Next, a fourth embodiment of the present disclosure will be described. In the fourth embodiment, the description will be done mainly about differences from the first embodiment to the third embodiment, and those elements of configuration that are the same as the first embodiment to the third embodiment are denoted by the same reference numerals and detailed description thereof will be omitted. The description of the first embodiment to the third embodiment can be suitably applied or supplemented in relation to those points of the fourth embodiment for which particular description is not provided.

Figure 7:
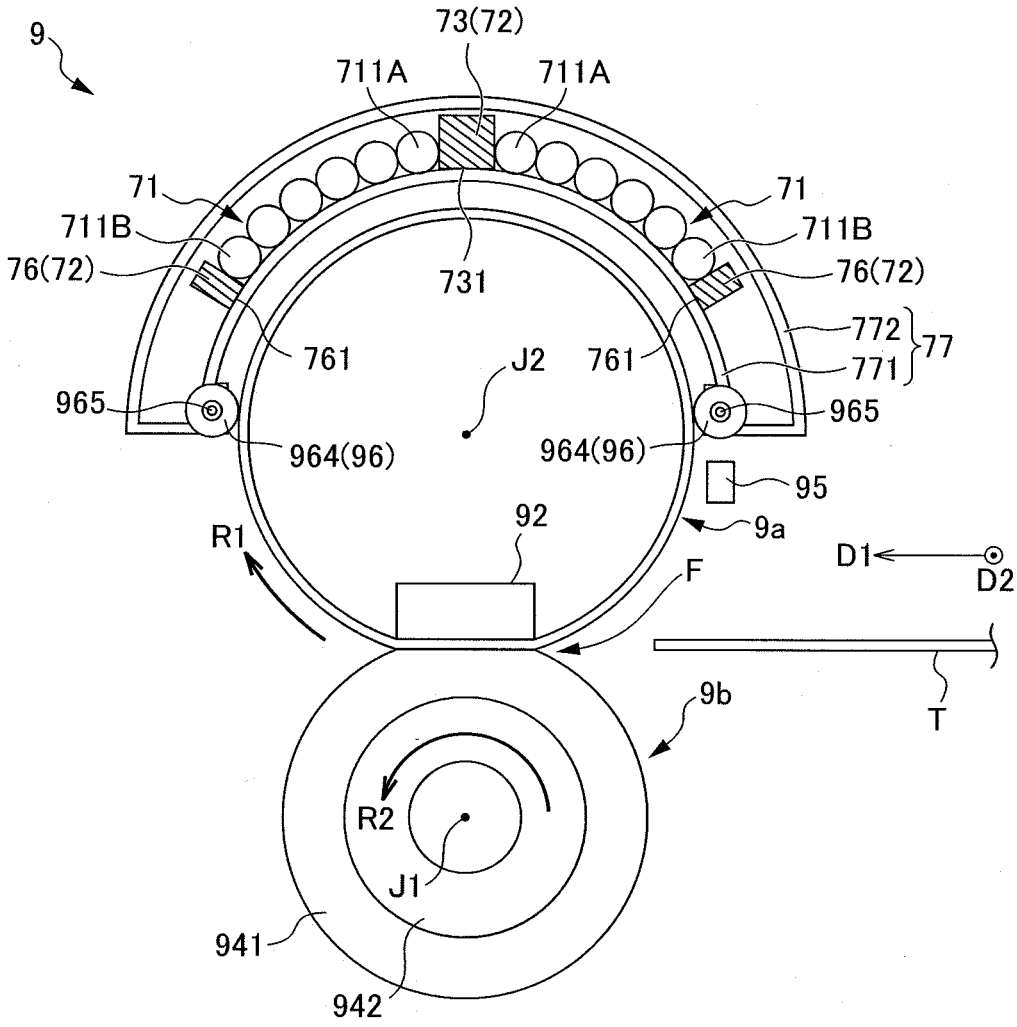
FIG. 7 is a sectional view illustrating respective constituent elements of a fixing unit in a printer according to a fourth embodiment of the present disclosure.

FIG. 7 is a sectional view illustrating respective constituent elements of the fixing unit 9 in the printer 1 according to the fourth embodiment of the present disclosure.

In the fourth embodiment, the main difference in relation to the first to the third embodiment is in the shape of the regulating portion 96 and the position of the regulating portion 96.

As illustrated in FIG. 7, the regulating portion 96 in the fixing unit 9 of the printer 1 according to the fourth embodiment is configured from two cylindrical rollers 964. The two cylindrical rollers 964 are disposed in proximity to both ends of the supporting member 77 of the heating unit 70 with reference to the sheet conveyance direction D1. The two cylindrical rollers 964 are rotatably supported by a shaft member 965 provided on the supporting member 77.

The two cylindrical rollers 964 are separately disposed on the upstream and downstream sides in the first peripheral direction R1 in a symmetrical configuration to the plane connecting the pressing member 92 with the second rotation axis J2 of the heating rotary belt 9*a*. More precisely, the two cylindrical rollers 964 are disposed with a separation of substantially 180° in an angle θ2 centering on the second rotation axis J2 of the heating rotary belt 9*a*.

The outer peripheral surface of the two cylindrical rollers 964 abut with the outer peripheral surface of the heating rotary belt 9*a* in the non-paper passing region on the outer side of the maximum paper passing region 901. Therefore the two cylindrical rollers 964 are driven to rotate about the axial member 965 by the rotation of the heating rotary belt 9*a*.

By using the printer 1 according to the fourth embodiment, the following effects can be obtained in addition to the effects exhibited by the first embodiment to the third embodiment.

The regulating portion 96 of the fixing unit 9 of the printer 1 according to the fourth embodiment is configured by two cylindrical rollers 964 that are driven to rotate by the rotation of the heating rotary belt 9*a*. As a result, the cylindrical rollers 964 as a regulating portion 96 enable a reduction in the contact resistance with the heating rotary belt 9*a*. In this manner, the two cylindrical rollers 964 enable a reduction in the possibility of damage such as marking on the heating rotary belt 9*a* caused by contact with the heating rotary belt 9*a*. Therefore, while the heating rotary belt 9*a* smoothly rotates, and deformation of the heating rotary belt 9*a* is regulated to thereby keep the distance between the induction coil 71 and the outer peripheral surface of the heating rotary belt 9*a* constant.

Although the embodiments have been described above, the present disclosure is not limited to the above embodiments, may be worked in various aspects.

For example, in the third embodiment described above, although the regulating portion 96 was configured by three third ribs 963, the regulating portion may be configured by four or more ribs.

Furthermore, in the fourth embodiment described above, although the regulating portion 96 was configured by two cylindrical rollers 964, the regulating portion 96 may be configured by three or more cylindrical rollers.

There is no particular limitation on the type of image forming apparatus according to the present disclosure, and in addition to a printer, application is possible in relation to a copying machine, a facsimile, or a multifunction peripheral combining such devices.

The sheet-shaped transfer material is not limited to paper, and may for example be a film sheet.

What is claimed is:

1. A fixing unit comprising:

a heating rotary belt;

a pressing member that is disposed in an inner portion of the heating rotary belt, and that abuts with an inner surface of the heating rotary belt;

a pressing rotor that is disposed facing the heating rotary belt, and that is configured to form a fixing nip with the heating rotary belt by sandwiching the heating rotary belt with the pressing member;

a induction coil separated from an external surface of the heating rotary belt and disposed along the external surface, and configured to generate a magnetic flux to generate heat in the heating rotary belt;

a magnetic core portion configured to form a magnetic path for the magnetic flux generated by the induction coil;

a regulating portion configured to regulate the deformation of the heating rotary belt by abutment with the external surface of the heating rotary belt; and a supporting member disposed on the side of the heating rotary belt relative to the induction coil to thereby face the external surface of the heating rotary belt, and support the induction coil; wherein:

the regulating portion is disposed on the supporting member, and regulates the deformation of the heating rotary belt by abutment with the external surface of the heating rotary belt to keep a distance between the induction coil and the external surface of the heating rotary belt constant; and wherein the regulating portion is disposed along the supporting member, and is formed from an arcuate rib that extends in a first peripheral direction that is the peripheral direction of the heating rotary belt along the external surface of the heating rotary belt, and abuts along the external surface of the heating rotary belt.

2. The fixing unit according to claim 1, wherein the regulating portion is disposed on a first side and a second side in a symmetrical configuration with reference to a plane connecting the rotation axis of the heating rotary belt and a central portion of the pressing member with reference to the direction of conveyance of the transfer material.

3. The fixing unit according to claim 1, wherein the end of the arcuate rib on the upstream side in the first peripheral direction of the heating rotary belt is formed to gradually approach the external surface of the heating rotary belt from the upstream side towards the downstream side of the first peripheral direction of the heating rotary belt.

4. A fixing unit according to claim 1 comprising, a heating rotary belt;

a pressing member that is disposed in an inner portion of the heating rotary belt, and that abuts with an inner surface of the heating rotary belt;

a pressing rotor that is disposed facing the heating rotary belt, and that is configured to form a fixing nip with the heating rotary belt by sandwiching the heating rotary belt with the pressing member;

a induction coil separated from an external surface of the heating rotary belt and disposed along the external surface, and configured to generate a magnetic flux to generate heat in the heating rotary belt;

a magnetic core portion configured to form a magnetic path for the magnetic flux generated by the induction coil; and a regulating portion configured to regulate the deformation of the heating rotary belt by abutment with the external surface of the heating rotary belt;

wherein the regulating portion abuts with the external surface of the heating rotary belt, and is configured from one or a plurality of cylindrical rollers that rotate in response to the rotation of the heating rotary belt.

5. An image forming apparatus comprising: an image carrier that form an electrostatic latent image on a surface thereof;

a development unit that develops the electrostatic image formed on of the image carrier as a toner image; and a transfer unit that transfers the toner image formed on the image carrier directly or indirectly to the sheet-shaped transfer material; and a fixing unit;

wherein the fixing unit comprises a heating rotary belt; a pressing member that is disposed in an inner portion of the heating rotary belt, and that abuts with an inner surface of the heating rotary belt; a pressing rotor that is disposed facing the heating rotary belt, and that is configured to form a fixing nip with the heating rotary belt by sandwiching the heating rotary belt with the pressing member;

a induction coil separated from an external surface of the heating rotary belt and disposed along the external surface, and configured to generate a magnetic flux to generate heat in the heating rotary belt; a magnetic core portion configured to form a magnetic path for the magnetic flux generated by the induction coil;

a regulating portion configured to regulate the deformation of the heating rotary belt by abutment with the external surface of the heating rotary belt; and a supporting member disposed on the side of the heating rotary belt relative to the induction coil to thereby face the external surface of the heating rotary belt, and support the induction coil; wherein:

the regulating portion is disposed on the supporting member, and regulates the deformation of the heating rotary belt by abutment with the external surface of the heating rotary belt to keep a distance between the induction coil and the external surface of the heating rotary belt constant; and wherein the regulating portion is disposed along the supporting member, and is formed from an arcuate rib that extends in a first peripheral direction that is the peripheral direction of the heating rotary belt along the external surface of the heating rotary belt, and abuts along the external surface of the heating rotary belt.

6. The image forming apparatus according to claim 5, wherein the regulating portion is disposed on a first side and a second side in a symmetrical configuration with reference to a plane connecting the rotation axis of the heating rotary belt and a central portion of the pressing member with reference to the direction of conveyance of the transfer material.

7. The image forming apparatus according to claim 5, wherein the end of the arcuate rib on the upstream side in the first peripheral direction of the heating rotary belt is formed to gradually approach the external surface of the heating rotary belt from the upstream side towards the downstream side of the first peripheral direction of the heating rotary belt.

* * * * *